United States Patent [19]

Feeney

[11] 4,116,432

[45] Sep. 26, 1978

[54] STABILIZED PYLON AND MODEL AIRCRAFT SYSTEM

[76] Inventor: John J. Feeney, 1154 Dorset La., Costa Mesa, Calif. 92626

[21] Appl. No.: 781,776

[22] Filed: Mar. 28, 1977

[51] Int. Cl.[2] ..... A63H 27/04

[52] U.S. Cl. ..... 272/31 A

[58] Field of Search ..... 272/31 A, 31 B, 31 R; 46/77, 78, 76 R, 76 A

[56] References Cited

U.S. PATENT DOCUMENTS

| | | | |
|---|---|---|---|
| 1,189,647 | 7/1916 | Anderson, Jr. | 272/31 A |
| 1,331,418 | 2/1920 | Craig | 46/77 |
| 1,925,427 | 9/1933 | Wurtzer | 46/77 UX |
| 2,292,705 | 8/1942 | Lohse | 272/31 A |
| 2,299,582 | 10/1942 | Lohse | 272/31 A |
| 2,580,405 | 1/1952 | Byers | 46/77 |
| 2,649,263 | 8/1953 | Bayuk | 272/31 A X |
| 2,672,338 | 3/1954 | Freedman | 272/31 A |
| 2,947,108 | 8/1960 | Dodd, Jr. et al. | 46/77 |
| 3,596,399 | 8/1971 | Barbee | 272/31 A UX |

FOREIGN PATENT DOCUMENTS

| | | | |
|---|---|---|---|
| 264,627 | 9/1913 | Fed. Rep. of Germany | 272/31 A |

OTHER PUBLICATIONS

American Modeler, Jan. 1958, p. 6, Three-line Bridle Anchor and Tether Cord.

*Primary Examiner*—Richard C. Pinkham
*Assistant Examiner*—Arnold W. Kramer
*Attorney, Agent, or Firm*—Poms, Smith, Lande & Glenny

[57] ABSTRACT

A stablized gasoline powered model airplane and pylon assembly has a thin vertically extending pylon of substantially uniform cross-section, a base for supporting the pylon vertically without circumferential lateral interference, a gasoline powered model airplane mounted for powered flight around the pylon by a small ring freely mounted on the pylon and a restraint line extending between the model airplane and the ring. A circular element of resilient plastic is secured near the upper end of the pylon for engaging the ring on the restraining wire to limit vertical travel, and oscillation of the model during flight. The model airplane is constrained to take-off, circle about the pylon, climb to the height of the pylon, and, following engagement with the flexible damping and stop element, to continue circular flight about the upper end of the pylon until fuel is exhausted and then to glide to a landing.

10 Claims, 5 Drawing Figures

40b
36b
33
30
37
32
40a
34b
31
36a
34a
34c
34
35

35
23
22

20
21
13
35
20

13
17
17
13

12
16
11
16
10
16
30c
34
40b
40a
35
21
30b
34
40b
40a
35
III
III
20
13
15
14
35
10
30a
34
40b
40a

STABILIZED PYLON AND MODEL AIRCRAFT SYSTEM

BACKGROUND OF THE INVENTION

The present invention relates in general to assemblies which control the flight path of a scale model airplane powered by a gasoline type powerful engine. In particular, the present invention relates to flight control about a pylon.

Previous attempts to control the flight of a model airplane about a pylon are shown in Freedman, U.S. Pat. No. 2,672,388 and Lohse, U.S. Pat. No. 2,299,582. These prior references utilize a single restraining line interconnecting the pylon and a wing tip of the model airplane. This is particularly disavantageous in that the single connection to the wing tip will act as a pivot or swivel should the model airplane encounter any turbulence as it flies about the pylon. These systems do not maintain the necessary control of the attitude of the model airplane and, upon encountering turbulence, a loss of control and subsequent crash will result.

Additionally, both prior patents disclose a rigid stop apparatus to prevent the model airplane from lifting the restraining line off the top of the pylon. The use of a rigid stop in both cases results in vertical oscillation of the model airplane once the restraining line connector contacts the stop. The vertical oscillations become progressively worse, constantly increasing in vertical amplitude until the model airplane crashes.

A further disadvantage of the Freedman apparatus is that it utilizes a pylon or support which is rectangular in cross-section and a ring which is larger in diameter than the diameter of the stop at the top of the pylon to connect the restraining line to the pylon. It has been found that in models which utilize the gasoline powered motor, the smallest available motor is so powerful that it could easily lift the pylon ring vertically up and over the stop and ultimately free the aircraft from the pylon, particularly with the erratic motion which would be produced by the four-sided pylon or support. The possible resultant condition of uncontrolled flight of the gasoline powered model airplane would be extremely hazardous to spectators and, even if no one were injured, the unrestrained model airplane could once again crash.

SUMMARY OF THE INVENTION

It is therefore a primary object of the present invention to provide an improved apparatus for attaching a model airplane to a pylon or pole so as to maintain the model airplane in a proper flying attitude at all times during operation.

It is a further object of the present invention to control the model airplane during flight to prevent vertical oscillation of the model airplane once it has reached the top of the pylon.

An additional object of the present invention is to prevent the model airplane from freeing itself of the control of the pylon during the flight of the model airplane about the pylon.

A further object of the invention is to disclose and provide a flight test bed for various types of model aircraft.

Another object of the present invention is to test a gasoline powered model airplane under substantially free-flight conditions in a very limited area, or space.

Generally stated, the present invention involves an improved gasoline powered type model airplane and pylon assembly which includes the provision of a thin vertically extending pylon of substantially uniform cross-section. The pylon is supported vertically without circumferential lateral interference. A gasoline powered model airplane and means for adjusting the model airplane for climbing flight are provided. Additionally, a small ring freely mounted on the pylon and a restraint line extending between the model airplane and the ring are provided to constrain the model airplane to circular flight about the pylon. A flexible damping and stop member secured near an upper end of the pylon engage the ring or restraint line to reduce vertical oscillation of the model during flight. In operation, the model airplane is constrained to take-off, circle about the pylon, climb to the height of the pylon, and, following engagement with the flexible damping and stop member, to continue circular flight about the upper end of the pylon until fuel is exhausted, and then to glide to a landing.

A particular advantage of the present invention is that free flight of the gasoline powered model aircraft may be simulated in an area which is as small as 10 feet in diameter.

A more complete understanding of the improved gasoline powered model airplane and pylon assembly in accordance with the present invention, as well as a recognition of additional objects and advantages, will be afforded to those skilled in the art from a consideration of the following detailed description of an exemplary embodiment thereof. Reference will be made to the appended sheet of drawings which will first be discussed briefly.

DETAILED DESCRIPTION OF AN EXEMPLARY EMBODIMENT

Figures 1, 2, 3, 4, 5:
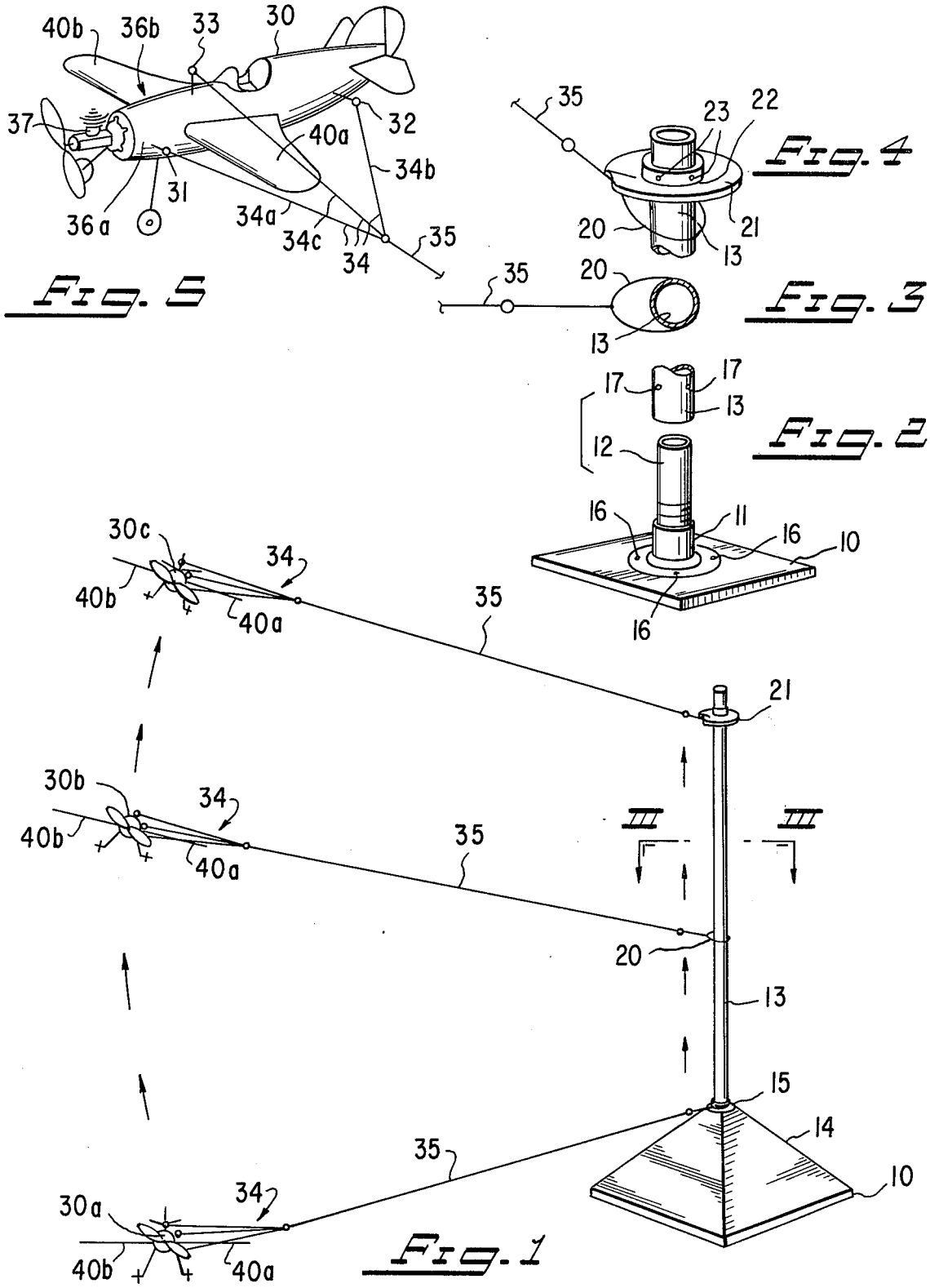
FIG. 1 is a perspective view of the improved assembly of the present invention showing the progression of the gasoline powered model airplane from a take-off position on the ground to a final flight altitude about the top of the pylon.
FIG. 2 is a perspective view in detail showing a connection of the pylon to a support base.
FIG. 3 is a view through the plane III—III of FIG. 1 showing the relationship between the restraining line, the pylon and a small ring freely mounted on the pylon having a generally elliptical shape which interconnects the pylon and the restraining line.
FIG. 4 is a prespective view showing the flexible damping and stop means of the present invention as well as the interaction between the flexible damping and stop means and a portion of the securing means which secure the model airplane to the pylon.
FIG. 5 is a perspective view showing a gasoline powered model airplane and the harness means which interconnects the model airplane and the restraint line and controls flight attitude of the model airplane during operation of the improved assembly of the present invention.

Referring first to FIG. 1, an improved gasoline powered model airplane and pylon assembly is shown. A thin vertically extending pylon 13 of substantially uniform cross-section is supported vertically without circumferential lateral interference by pylon base 10 which is provided with a removable cover 14. As shown in detail in FIG. 2, a pipe flange 11 is secured to pylon base 10 by means of fasteners 16. Fasteners 16 may comprise bolts, rivets, screws and the like as is well known. A section of pipe 12, which in the exemplary embodiment shown is approximately 12 inches long, is screwed into pipe flange 11 and pylon 13 is then slipped over pipe 12 and held firmly in place by set screws 17.

A gasoline powered model airplane shown generally at 30 is secured to pylon 13 by securing means which include a small ring 20 freely mounted on pylon 13 and a restraint line shown generally at 35 which extends between model airplane 30 and ring 20.

As best seen in the exemplary embodiment shown in FIG. 5, restraint line 35 is connected to harness means 34 which comprises a plurality of lines **34*a*, 34*b*, and 34*c* which are separately attached to points 31, 32, and 33, respectively of model 30. Harness means 34 interconnects model 30 and restraint line 35 and controls the flight attitude of model 30 during operation of the assembly. Harness means 34 comprises a first harness line 34*a* connected to a forward portion of model 30, a second harness line 34*b* connected to a rearward portion of model 30 relative to first harness line 34*a* and a third harness line 34*c* connected to model 30 intermediate first harness line 34*a* and second harness line 34*b***.

As may be seen in FIG. 5, first harness line **34*a* and second harness line 34*b* are connected to model 30 generally below a longitudinally extending central axis of the model. Third harness line 34*c* is connected to a top portion of model 30 generally above the central axis of the model. Additionally, third harness line 34*c* is connected to model 30 generally forward of a mid-point between the connections of first harness line 34*a* and second harness line 34*b* to the model. Additionally, it should be noted that first harness line 34*a* and second harness line 34*b* are attached to a common lateral surface shown at 36*a* of the fuselage of the model. In practicing the present invention, lateral surface 36*a*** of the fuselage will be the inside lateral surface during operation of the assembly.

In thus having first harness line **34*a* and second harness line 34*b* connected below the central axis of the model 30, inside wing 40*a* is prevented from tilting downward under the influence of atmospheric turbulence encountered by the model airplane during flight. The attachment of third harness line 34*c* to a top portion of model 30 above the central axis prevents inside wing 40*a* from tilting upward. Thus, the combination of harness lines 34*a*, 34*b*, and 34*c* controls the flight attitude of model 30 during operation of the improved assembly of the present invention by maintaining the wings 40*a* and 40*b* of the model generally parallel to restraint line 35** during flight.

In a specific exemplary embodiment of the present invention wherein model 30 has a single pair of wings **40*a* and 40*b* mounted to opposing lateral surfaces 36*a* and 36*b* respectively of the fuselage of the model and not positioned significantly above the central axis of the model, third harness line 34*c* is connected to a central portion of a top surface of the fuselage at a point rearward of first harness line 34*a* and approximately one-third the distance between first harness line 34*a* and second harness line 34*b*** as best seen in FIG. 5.

In a further exemplary embodiment of the present invention (not shown) wherein the model airplane has at least one pair of wings mounted to opposing lateral surfaces of the fuselage and positioned substantially above the central axis of the model, i.e., a "high wing" model or in biplane models having a plurality of pairs of wings, third harness line **34*c*** is connected to a tip portion of the upper inboard wing rather than directly to the central portion of the top surface of the fuselage.

In order to prevent first harness line **34*a* and second harness line 34*b* from contacting inboard wing 40*a*, the harness lines are attached to relatively widely separated connection points 31 and 32 respectively. Additionally, as may be seen in FIG. 5, a stand-off connector 33 is provided for third harness line 34*c* to provide additional clearance between a tip portion of wing 40*a*** of low-wing monoplanes and the third harness line.

In the instant invention, means are provided for adjusting model airplane 30 for climbing flight, and this involves the control surfaces on the model airplane. In addition the present invention includes means for locating the center of gravity of the airplane generally forward of a leading edge of a wing structure of the airplane by suitable distribution of weight. This differs from the generally accepted practice of balancing a scale model flying aircraft at a point approximately one-third the wing width back from the leading edge of the wing. The location of the center of gravity of the airplane forward of a leading edge of a wing structure prevents the model airplane from flying in a tail down position, approaching a stall, and not attaining climbing speed or proper flying attitude. When the model airplane is properly adjusted for climbing flight, it will circle about pylon 13 and, as it circles, climb to the height of the pylon as shown in FIG. 1, progressing from position **30*a* to position 30*b* and finally to position 30*c*. In order for model airplane 30 to climb unimpeded by restraint line 35, ring 20 must rotate freely about pylon 13 and, additionally, must slide freely up and down the pylon. It is a further requirement that ring 20 be light enough in weight to be readily lifted by model airplane 30** as it climbs.

As best seen in FIG. 3, ring 20 has a generally elliptical shape in order to maintain the attitude of the ring in proper relation to the attitude of the plane as the plane and ring descend when the motor stops and the plane glides to a landing as well as to prevent ring 20 from binding on pylon 13 during ascent and descent of the model and ring.

As the model airplane 30 reaches a maximum height, flexible damping and stop means 21 which is secured near an upper end of pylon 13 engages a portion of the securing means and prevents ring 20 from rising beyond the upper end of pylon 13 which would result in model airplane 30 flying free in an uncontrolled manner.

In the exemplary embodiment of the present invention shown in FIG. 4, flexible damping and stop means 21 is secured to pylone 13 by means of set screws 23 which extend through collet 22 of flexible damping and stop means 21.

Flexible damping and stop means 21 has a generally circular configuration. In the exemplary embodiment of the present invention, flexible damping and stop means 21 has a diameter in the range of two to four times greater than the major axis of elliptical ring 20. This prevents elliptical ring 20 from inadvertently riding over a portion of the flexible damping and stop means and becoming jammed so as to prevent rotation of the ring. Should this occur, control of the model airplane would be lost and a crash will result.

The provision of a flexible damping and stop means, as opposed to a rigid damping and stop means, prevents vertical oscillation of model airplane 30 when elliptical ring 20 and restraint line 35 reach the top of pylon 13 and come in contact with flexible stop means 21.

As contact is made between the securing means which includes elliptical ring 20 and restraint line 35, flexible damping and stop means 21 is slightly deformed from a generally plainer configuration by the contact with the securing means. In thus deforming or "flexing," a damping effect is provided which prevents the generation of oscillating motion caused by the lift of the model airplane attempting to climb above the top of the pylon and the centrifugal force pulling out from the pylon in a straight line. With a rigid damping and stop means, the vertical oscillations become progressively worse, constantly increasing in vertical amplitude and eventually resulting in a crash.

To operate the improved gasoline powered model airplane and pylon assembly of the present invention, pylon 13 is mounted perpendicular to a generally flat base portion 10 which has a relatively large surface area and is capable of accepting a plurality of demountable weights. The demountable weights are placed on the flat base portion 10 and are enclosed within a removable housing shown at 14. The demountable weights used in the exemplary embodiment might comprise sand bags or the like. Typically, the demountable weights used should total at least fifty pounds in order to provide for the stability of pylon 13. As is readily apparent, the aforedescribed pylon base allows pylon 13 to be securely positioned without being permanently attached to an underlying surface such as a floor or the like.

Once the pylon and base have been assembled, elliptical ring 20 is positioned over pylon 13 and is slid down the pylon into contact with a lower stop 15. Restraint line 35 and harness means 34 are then connected to elliptical ring 20 thereby connecting model airplane 30 to the pylon.

To fly the model airplane, gasoline engine 37 is started and the model airplane 30 is restrained from moving until the engine has reached the maximum power output. At that time, the model airplane is released and begins to circle about the pylon. As the speed of the model airplane increases, the lift provided by the combination of control surface attitude and balance of the model tend to make the model airplane rise from position 30*a* to position 30*b* and finally to position 30*c*. the model airplane will continue to fly about pylon 13 in the attitude shown at 30*c* until fuel is exhausted. Then the model will continue to circle the pylon gradually losing speed and lift until the model airplane once again is on the ground as shown at 30*a*.

In a specific example, restraint line 35 is less than 8 feet in length, preferably approximately 4 feet in length, and a 5 foot tall pylon is used. The scale model aircraft is powered by a 0.020 cubic inch displacement gasoline engine and can be flown at speeds in excess of 40 miles per hour. With the above described assembly, the model airplane circles the pylon approximately 141 times per minute.

Thus, it may be seen that the herein described invention in an improved gasoline powered model airplane and pylon assembly provides an improved apparatus for attaching a model airplane to a pylon so as to maintain the airplane in a proper flying attitude at all times during operation. The improved apparatus of the present invention, particularly the flexible damping and stop means, control the model airplane during flight and prevents vertical oscillation of the model airplane once it has reached the top of the pylon. Further, the model airplane is prevented from freeing itself of the control of the pylon during the flight of the model airplane about the pylon. The improved assembly of the present invention thus discloses and provides a flight test bed for various types of model aircraft.

Incidentally, it may be noted in passing that the phrase gasoline powered type model aircraft is intended to refer to the class of high powered model aircraft which may be powered by a combination of methanol, nitro-methane and castor oil, with which the present model is actually powered, with known fuels in which gasoline is a major component, or with similarly powerful engines using electricity or solid fuels for propulsion, for example.

Having thus described an exemplary embodiment of an improved gasoline powered type model airplane and pylon assembly, it should be understood by those skilled in the art that various alternatives and modifications thereof may be made within the scope and spirit of the present invention which is defined by the following claims.

What is claimed is:

1. A stabilized gasoline powered type model airplane and pylon assembly comprising:

a thin vertically extending pylon of substantially uniform cross-section;

means for supporting said pylon vertically without circumferential lateral interference;

a gasoline powered type model airplane;

means for securing said airplane to said pylon, said securing means including a small bearing member or ring freely mounted on said pylon and a restraint line extending between said model airplane and said bearing member;

means for adjusting said airplane for climbing flight above the bearing member or ring;

flexible damping and stop means secured near an upper end of said pylon having an undersurface adapted to engage a portion of said securing means in any rotational position of said securing means for reducing vertical oscillation of said model during flight, whereby said model airplane is constrained to take off, circle about said pylon, climb the height of said pylon, so that said plane is circling at an elevation above the elevation of said damping and stop means; and, following engagement between said portion of said securing means and said flexible damping and stop means, to continue circular flight about said upper end of said pylon until fuel is exhausted, and to then glide to a landing; and means for providing vertical clearance around said pylon and above said damping and stop means to facilitate climbing flight to an elevation above the damping and stop means.

2. The improved assembly as defined in claim 1, wherein said securing means comprises:

first and second harness lines connected to said model below a longitudinally extending central axis of said model, said first harness line being connected to a forward portion of said model, and said second harness line being connected to a rearward portion of said model relative to said first harness line, a third harness line connected to said model intermediate said first and second harness lines, above said central axis, and generally forward of a mid-point between the connections of said first and second harness lines to said model.

3. The improved assembly of claim 2, wherein said first and second harness lines are attached to a common lateral surface of a fuselage of said model.

4. The improved assembly of claim 3, wherein:

said model has a single pair of wings mounted to opposing lateral surfaces of said fuselage and positioned below or not significantly higher than said central axis of said model; and said third harness line is connected to a central portion of a top surface of said fuselage at a point rearward of said first harness line and approximately one-third the distance between said first harness line and said second harness line.

5. The improved assembly of claim 2, wherein said first and second harness lines are relatively widely separated to prevent contact between either of said harness lines and a wing of said model airplane.

6. The improved assembly of claim 1, wherein the center of gravity of said airplane is located forward of a leading edge of a wing structure of said airplane.

7. the improved assembly of claim 1, wherein said small ring freely mounted on said pylon has a generally eliptical shape.

8. The improved assembly of claim 7, wherein said flexible damping and stop means has a generally circular configuration with a diameter thereof being in the range of two to four times greater than the major axis of said eliptical ring.

9. An assembly as defined in claim 1 wherein said restraint line is less than 8 feet in length, whereby said airplane makes more than one revolution around said pylon each second, and can be operated in a restricted space.

10. The improved assembly of claim 1, further comprising means including a flat base member of relatively large surface area for mounting said pylon, and means including a plurality of demountable weights fitted to overlie said base member, whereby upon mounting said base portion to said pylon and mounting said plurality of weights to said base portion, said pylon is securely positioned without being permanently attached to an underlying surface such as a floor or the like.

* * * * *